United States Patent [19]

Wood

[11] 4,129,422

[45] Dec. 12, 1978

[54] COAL GASIFICATION PLANT

[75] Inventor: Andrew Wood, Dunfermline, Scotland

[73] Assignee: British Gas Corporation, London, England

[21] Appl. No.: 771,330

[22] Filed: Feb. 23, 1977

[30] Foreign Application Priority Data

Mar. 22, 1976 [GB] United Kingdom ..... 11445/76

[51] Int. Cl.[2] ..... B01J 3/00

[52] U.S. Cl. ..... 48/62 R; 48/73; 48/87; 48/202; 48/DIG. 2; 222/591; 266/236; 432/96

[58] Field of Search ..... 48/77, 76, 62 R, 92, 48/63, 202, 210, 197 R, DIG. 2, 87; 110/28 P, 165 R; 122/235 N; 164/337, 335; 266/236, 271, 195, 196, 167; 222/591, 592; 75/46; 432/96

[56] References Cited

U.S. PATENT DOCUMENTS

| | | | |
|---|---|---|---|
| 2,961,722 | 11/1960 | Lilljekvist et al. | 222/591 |
| 3,429,972 | 2/1969 | Bussy | 222/592 |

FOREIGN PATENT DOCUMENTS

| | | | |
|---|---|---|---|
| 266180 | 3/1966 | Australia | 48/76 |

*Primary Examiner*—S. Leon Bashore
*Assistant Examiner*—George C. Yeung
*Attorney, Agent, or Firm*—Larson, Taylor and Hinds

[57] ABSTRACT

A removable annular hearth member, shaped to fit over the slag outlet of a slagging gasifier, comprises a cast body of high thermal conductivity having integral coolant passageways, said passageways being formed by shaping a metal tube into a coil having an inlet and an outlet, and casting metal to the desired shape around the coil such that the inlet and outlet communicate exteriorly of the cast body.

7 Claims, 4 Drawing Figures

Figure 1:
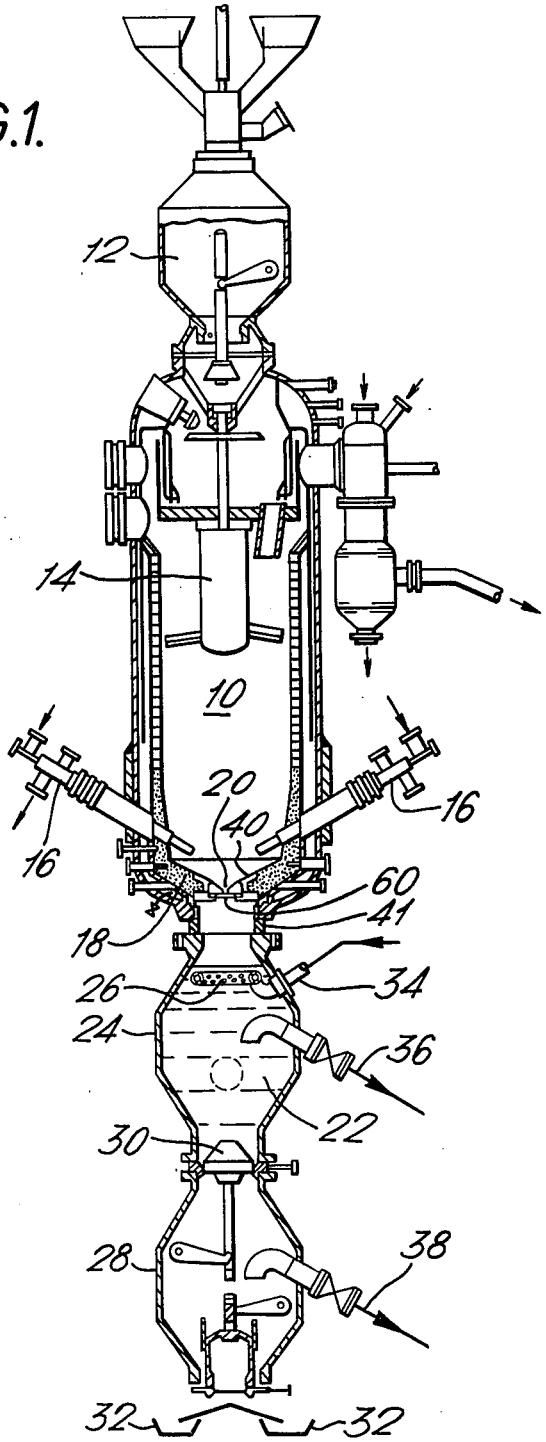

18
20
24
40
41
42
44
46
47
49
50
51
52
54
56
58
60
61
62
64
65
66
67
68
69
71
72
73
74
77

COAL GASIFICATION PLANT

This invention relates to coal gasification plant, and more particularly to coal slagging gasifier plants of the kind (hereinafter referred to as the kind specified) in which coal, or other carbonaceous fuel, is introduced into the top of a column-like gasifying vessel and is gasified under high pressure and temperature by means of a gas, for example oxygen and steam, introduced into the fuel bed through tuyeres. The residual ash collects as a molten slag and iron in the hearth of the gasifier vessel from which it is periodically discharged (commonly known as slag-tapping) downwardly through a slag tap outlet or orifice in the hearth into water contained in a quenching chamber vessel. Usually, a pool of molten slag and iron is maintained in the hearth by directing hot combustion product from a burner located beneath the slag tap orifice up the tap orifice to retain the pool of slag and iron in the hearth, the tapping of the molten slag and iron being initiated and controlled by stopping or reducing the burner output and reducing the pressure in the quenching chamber by controlled venting through its venting system so as to produce a diferential pressure between the quenching chamber and the gasifier vessel.

Examples of such slagging gasifier plant are those disclosed in United Kingdom patent specification No. 977,122 and The Gas Council Research Communication No's GC 50 and GC 112.

During the operation of such gasifiers, the slag tap and hearth are subject to aggressive erosion, corrosion and thermal attack by the molten slag and iron. High temperature and mobility of the slag and iron during slag-tapping and slag-retention operations make the containment materials of the slag-tap and its immediate hearth areas primarily subject to erosion and thermal attack.

Our co-pending U.S. patent application Ser. No. 744,026, filed 11/22/1976, describes a slagging gasifier (of the kind defined therein) in which the slag-removal orifice is located centrally within the gasifier hearth and is formed in a removable slag tap member comprising a solid mass of high thermal conductivity material having an integral passageway for circulating a coolant liquid through said mass and an inlet and outlet communicating said passageway exteriorly of the mass.

An object of the present invention is to provide an improved hearth arrangement in the vicinity surrounding the slag-tap.

According to one aspect of the present invention, in a slagging gasifier of the kind hereinbefore specified, there is provided a removable annular hearth member shaped to fit over and around the slag-tap and comprising a solid mass of high thermal conductivity material having an integral passageway for circulating a coolant liquid through said mass and an inlet and outlet communicating said passageway exteriorly of the mass, whereby in operation of the gasifier the exposed surface of the mass in direct contact with the molten slag is maintained at a temperature within the range 200° C. to 400° C.

The resistance to erosion of the annular hearth member (as for the slag-tap itself) depends on critical factors of design, involving, among things, the thermal conductivity of the material used, the shape and geometry of its metal mass, the size of its orifice, and the size, length and location of its coolant passageway with respect to the surfaces of the annular hearth member exposed to thermal attack.

The amount and rate of flow of coolant liquid is also an important factor in the design of the annular hearth member since the exposed surfaces must be cooled efficiently to maintain acceptable surface temperatures, but on the other hand it is important that excessive quantities of heat are not removed from the hearth. Typically, coolant liquid flow velocities of the order of 20 - 30 ft/sec are preferred to give a constant passageway wall temperature with the range 10° C. to 20° C.

Preferably, the slag tap member is formed of copper or copper and alloyed metal.

Preferably also, the coolant passageway is of spiral form, the convolutions thereof extending at least around and near to the exposed surfaces of the annular hearth member.

Conveniently, the coolant passageway may be provided by a metal tube of spirally coiled form, the ends of which project exteriorly of the surrounding metal mass to provide said inlet and outlet.

The uppermost annular surface of the hearth member is dished shape and its inner peripheral wall is formed in a surface revolution whose profile corresponds to that of the external profile of the slag tap so as to provide a snug fit therebetween for preventing any slag seepage, in use of the gasifier, between the slag tap and the hearth member.

Normally, the hearth area surrounding the annular hearth member slopes downwardly and will be provided by a bed of refractory material having liquid-cooled conduits embedded therein. However, where, for example, the sloping hearth is lined or additionally formed from a number of partially overlapping annular layers of refractory bricks, the annular hearth member may be surmounted by the lowermost annular layer of said bricks which can conveniently be cooled by mutual contact with the liquid-cooled hearth member which supports them.

According to another aspect of the invention, there is provided a method of manufacturing an annular hearth member for liquid-cooled operation in a slagging gasifier of the kind specified comprising, forming a metal tube into a coil having an inlet and an outlet, and casting a mass of copper or copper and alloyed metal around the coil to a desired annular shape such that the inlet and outlet communicate exteriorly of the said cast mass.

Preferably, the coiled tube is of a metal capable of retaining its shape without any appreciable distortion during the casting process in addition to providing good thermal contact with the casting metal.

For example, the tube may be formed of nickel-chrome or nickel-chrome and alloyed metals which also have a high resistance to corrosion.

Furthermore, the external surface of the tube may be provided with means for improving the bonding with the casting metal and to reduce any tendency to stress fractures of the casting metal upon cooling after casting especially where different metals are used for the tube and casting metal.

It will be appreciated that the invention includes within its scope an annular hearth member manufactured by the aforesaid methods, and to a slagging gasifier incorporating such a hearth member.

Figure 2:
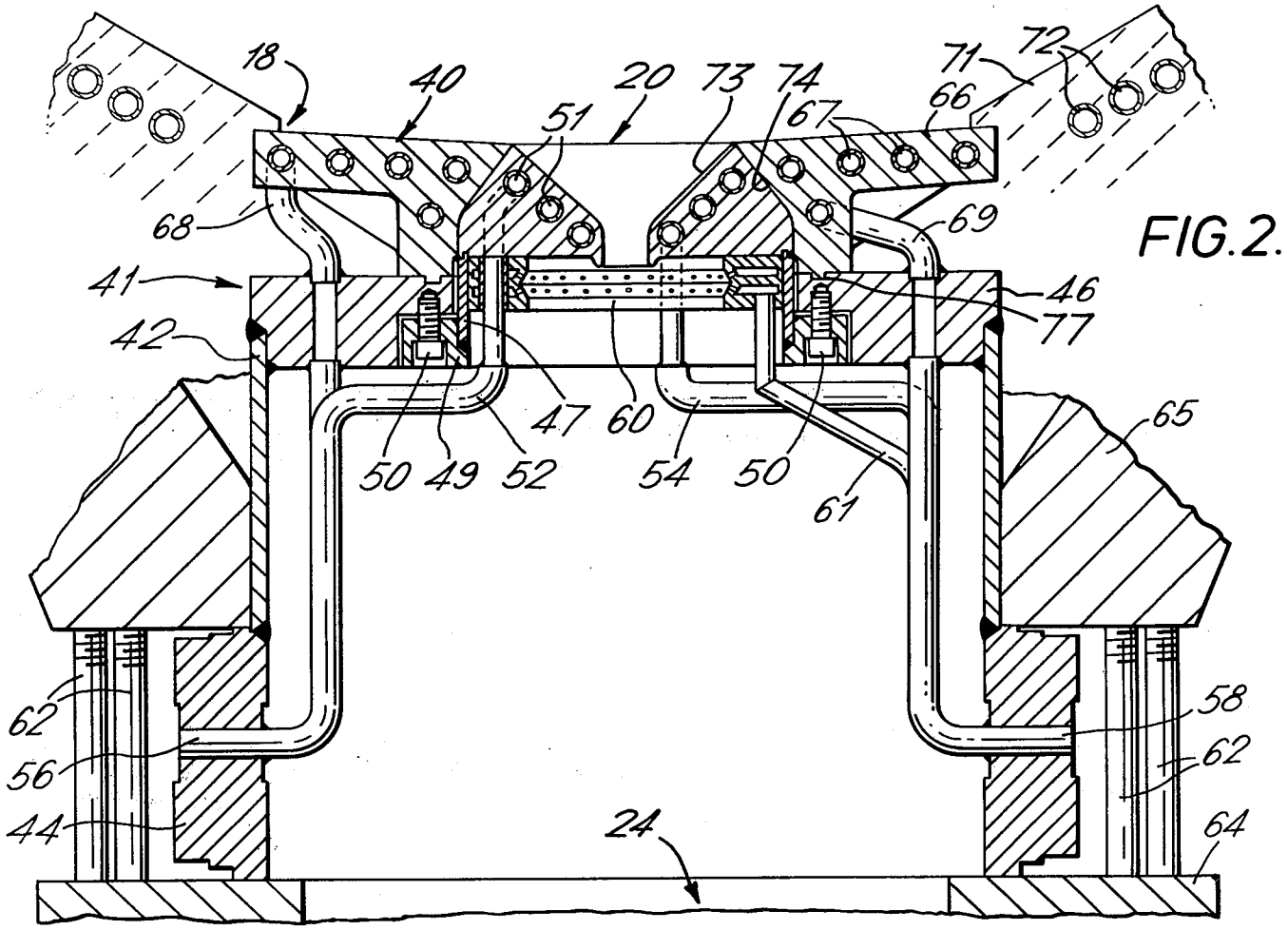
Figure 3:
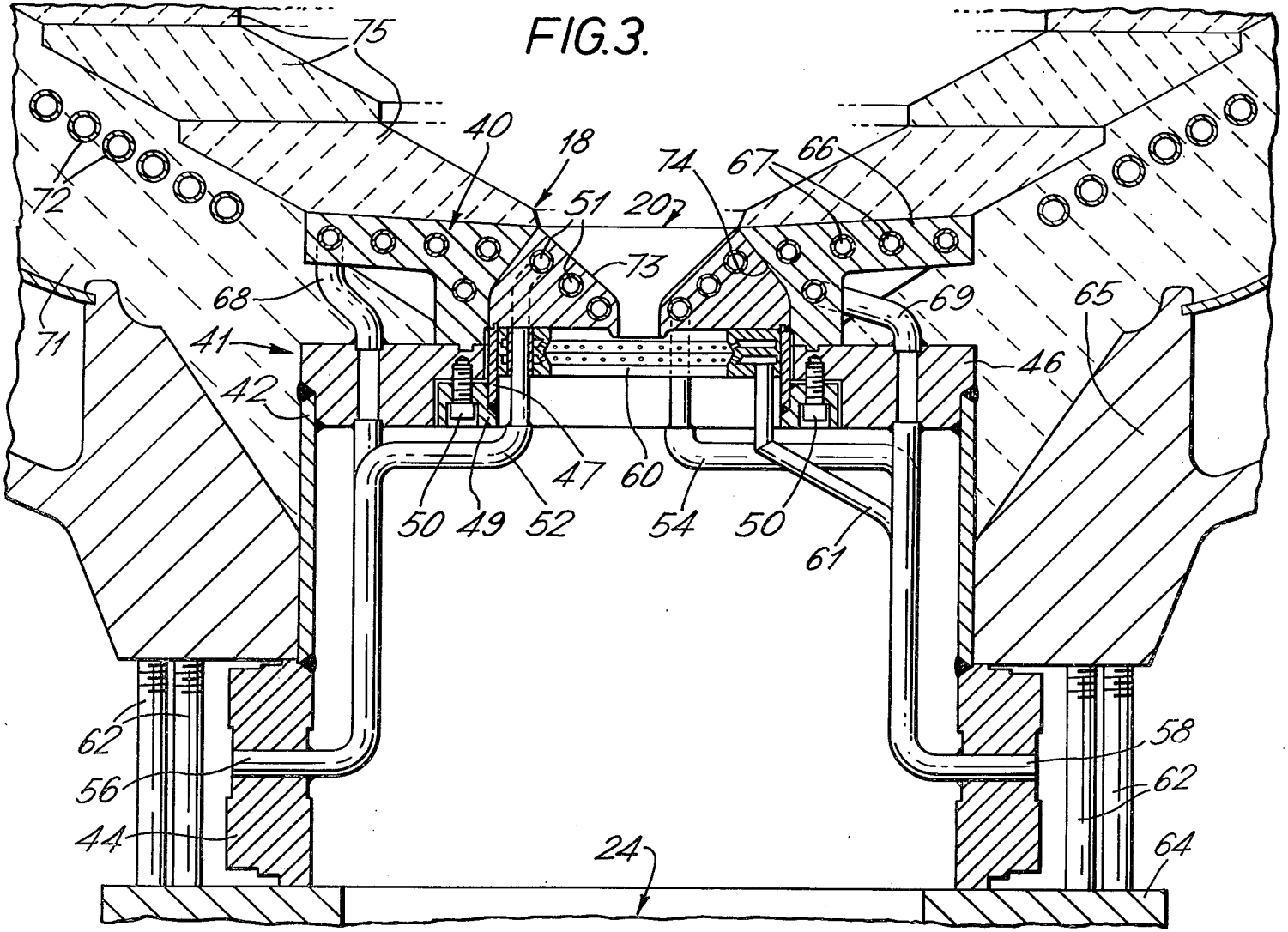
Figure 4:
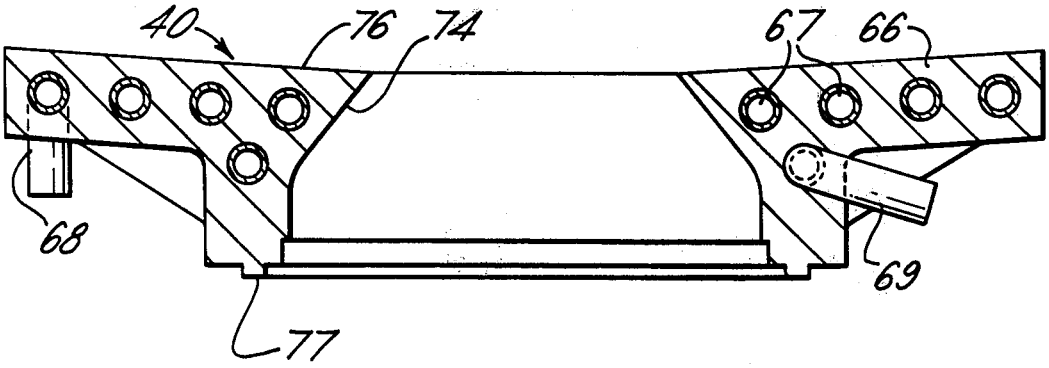

Two embodiments of the invention will now be described, by way of example, with reference to the accompanying diagrammatic drawings, in which:

FIG. 1 is a general longitudinal sectional elevation of a fixed-bed slagging gasifier incorporating a hearth arrangement in accordance with the invention, FIG. 2 is an enlarged longitudinal sectional elevation of an annular hearth arrangement of the first embodiment, FIG. 3 is an enlarged longitudinal sectional elevation of an annular hearth arrangement of the second embodiment, and FIG. 4 is a cross-sectional elevation to an enlarged scale of the annular hearth member shown in FIGS. 2 and 3.

Referring first to FIG. 1, the gasifier has a refractory-lined pressurised gasification chamber 10 into which coal is fed from a lock hopper 12 and distributed by rotatable distributor means 14. Oxygen and steam are introduced into the fuel bed (not shown) through tuyeres 16 to promote gasification of the coal. In use of the gasifier, a reservoir of molten slag collects on the sloping hearth 18 and is periodically passed, via a slag outlet or tap 20, into a water reservoir 22 contained in a quenching chamber 24 where it is rapidly quenched in a region of turbulent water issuing from a perforated tubular ring 26 before being transferred to a lock hopper 28, upon operation of a valve 30, in the form of a dense small-grained frit entrained with some of the quenching water. The frit is discharged from the lock hopper 28 onto moving conveyors 32. Water supplied to the quench ring 26 through an inlet 34 may partly be water recirculated through outlets 36, 38 from the quenching chamber and slag lock hopper 24, 28 respectively by pump and filter means (not shown). The region of the hearth surrounding the slag tap 20 is provided with an annular hearth member 40.

Referring also to FIGS. 2 and 3, the quenching chamber 24 is secured in a gas-tight manner to the bottom of the gasifier chamber 10 through the intermediary of a sandwich flange assembly 41 which consists of a cylindrical steel sleeve 42 having a thick steel flange member 44 welded to its lower end and a steel annular block 46 welded to its upper end. The slag tap 20 is supported on top of a collar 47 which is welded to a ring 49 secured to the underside of the block by bolts 50. Coolant water is fed to coiled waterways 51 formed in the slag tap 20 through inlet and outlet pipes 52, 54 whose external connections 56, 58 pass through the flange 44. The annular hearth member 40 consists of a cast metal body 66 and is supported on top of the annular block 46 of the flange assembly 41. Coolant water is also fed to coiled waterways 67 formed in the cast body 66 through inlet and outlet pipes 68, 69 whose external connections (not shown) also pass through the flange 44. A nozzle-mix ring burner 60 is secured co-axially within the collar 47 about its central aperture, and the air and/or oxygen and gas supply pipes 61 thereto (only one of which is seen) have terminal connections (not shown) in the flange 44.

Preferably, the assembly 41 is secured in position in a gas tight manner by means of bolts 62 which draw up the flange 64 of the quenching chamber towards the flange 65 at the base of the gasifier chamber so as to clamp the flange 44 of the assembly therebetween. With this arrangement, the burner 60 and the slag tap 20 can be readily removed by first uncoupling the coolant inlet and outlet pipes to the slag tap and the supply pipes 61 to the burner, and then unbolting and lowering the ring 49 with its sleeve 47.

In a similar manner, the supplies and services to and from other ancillary apparatus (not shown), for example, venting means for reducing the pressure in the communicating quenching chamber 24, burner ignition and flame detection devices, thermocouples and other coolant fluid supplies, together with inspection sight glasses for viewing conditions inside the flange assembly, can all have terminal connections in the flange 44 so as to be readily removably therewith from the gasifier vessel.

Should any maintenance be required to the annular hearth member, slag tap, burner or other apparatus or services, it is a relatively easy operation to remove the bolts 62, from between the flanges 64 and 65, disconnect the service connections to the terminals in the flange 44, and move the composite quench vessel and slag lock hopper 24, 28 sideways (possibly on guide rails) so as to enable the complete flange assembly 41 to be withdrawn from the base of the gasifier vessel for servicing or possible replacement with a standby assembly. In some cases, however, where only the slag tap and/or burner require servicing or replacement, then this can be done as aforesaid without removing the whole of the sandwich flange assembly.

In the first embodiment of a hearth arrangement shown in FIG. 2, the sloping hearth 18 is provided by the combination of the annular hearth member 40 and a surrounding bed 71 of refractory material having liquid-cooled conduits 72 embedded in the bed. The sloping upper surface of the hearth member 40 merges with the downwardly and inwardly sloping tundish 73 of the slag tap 20, whilst the inner peripheral wall 74 of the hearth member is so shaped to correspond with the outer peripheral surface of the slag tap 20 thereby to provide a snug fit therewith designed to prevent ingress of molten slag therebetween in use of the gasifier.

The second embodiment of a hearth arrangement shown in FIG. 3 differs only from the first embodiment in that the sloping hearth 18 further includes four partially superimposed layers of refractory bricks 75 (only two complete layers of which are shown), for example silicon-carbide bricks. As will be seen, the lowermost layer of bricks are supported by the hearth member 40 and are thereby cooled by conduction of heat to the liquid-cooled coils 67 formed therein.

Referring now to FIG. 4, the hearth member 40 comprises a body 66 of copper or copper and alloyed metal cast around a spirally coiled pipe 67 having an inlet 68 and an outlet 69, for the circulation of coolant water, projecting to beneath the body. A tundish surface 76 of the hearth member is of shallow frusto-conical form and the inner peripheral surface 74 of the body 66 is shaped to corresond to the outer peripheral surface of the gasifier slag tap. An annular rib 77 is provided on the base of the body 66 for co-axial engagement with an annular recess in the sandwich flange assembly.

In a specific example of an annular hearth member, the coiled pipe 67 was formed of nickel-chrome alloy, for example Inconel 600, about 30 feet in length, with an inside diameter of 0.75 inch and wall thickness of 0.125 inch. The overall diameter of the cast body 66 was about 28 inches with an overall height of about 5.5 inches. The diameter of the cylindrical portion of the peripheral wall 74 was about 12.75 inches, merging into the sloping surface which is at an angle of 50° to the horizontal. Preferably, the outer surface of the cast-in length of the coiled pipe may be provided with means for improving the bond with the casting metal which enhances heat transmission to the coolant liquid, and to obviate any tendency to fracture of the casting upon cooling after the casting process. The coiled pipe 67 is located within the cast body 66 so that the convolutions thereof extend at least around and adjacent the surfaces of the tundish 76 and inner wall 74, and preferably, those convolutions which are adjacent said surfaces are spaced therefrom to between 0.25 inch and 1.5 inches. The hearth member is made by first forming the pipe 67 into the desired spirally coiled form, supporting the pipe by suitable means in a suitable mould from which the inlet 68 and outlet 69 protrude, and casting copper or copper alloy in the mould to form the body 66. This method of manufacture gives a good contact and thus heat transmission between the body 66 and the coolant conduit formed by the pipe 67.

I claim:

1. In a coal slagging gasifier comprising: a gasifying vessel; means for introducing coal into said vessel for gasification thereof in said vessel; means for introducing oxygen and steam into said vessel to effect gasification of coal therein; and a hearth located at the bottom of said vessel and including a slag tap orifice located centrally within said hearth for removing slag from the vessel; the improvement wherein said hearth further includes means for defining a removable annular hearth member located so as to fit over and around said slag tap orifice and comprising a solid mass of high thermal conductivity material having means defining an integrally formed passageway for circulating a coolant liquid at a pre-determined rate of flow through said mass, and means defining an inlet and outlet communicating said passageway exteriorly of the mass, whereby in operation of the gasifier the exposed surfaces of the mass in direct contact with the molten slag are maintainable at a temperature within the range 200° C. to 400° C.

2. An improved coal slagging gasifier according to claim 1 wherein said annular hearth member comprises copper or copper and alloyed metal.

3. An improved coal slagging gasifier according to claim 1 wherein said coolant passageway is of spiral form whose convolutions extend at least adjacent to the surface of said hearth member exposed to slag in said vessel.

4. An improved coal slagging gasifier according to claim 3 wherein said coolant passageway comprises a metal tube of spirally coiled form, the ends of which project exteriorly of the surrounding metal mass to provide said inlet and outlet.

5. An improved coal slagging gasifier according to claim 1 wherein said slag tap orifice is provided in a slag tap, wherein the uppermost annular surface of said hearth member slopes downwardly towards its center, and wherein the inner peripheral wall of said hearth member is formed in a surface of revolution whose cross-sectional profile corresponds to the external surface profile of said slag tap.

6. An improved coal slagging gasifier according to claim 1 wherein an area of said hearth surrounding said annular hearth member slopes downwardly towards the center and is lined with a plurality of partially overlapping layers of refractory bricks, and wherein said annular hearth member is surrounded by the lowermost annular layer of said bricks which are thereby cooled by mutual contact with the liquid-cooled hearth member which supports them.

7. In a method of gasifying coal in a coal slagging gasifier comprising introducing coal, oxygen and steam into a gasifying vessel, maintaining the temperature within said gasifier sufficient to gasify the coal and to form a molten slag at the bottom of said vessel, and periodically discharging slag downwardly through a slag tap orifice located centrally within said hearth located at the bottom of said vessel, the improvement wherein the hearth further includes means for defining a removable annular hearth member located so as to fit over and around said slag tap orifice and comprising a solid mass of high thermal conductivity material having means defining an integrally formed passageway for circulating a coolant liquid through said mass, and means defining an inlet and outlet communicating said passageway exteriorly of the mass, and circulating coolant liquid through said passageway at a flow rate sufficient to maintain the exposed surfaces of said mass in direct contact with the molten slag at a temperature of from 200° C. to 400° C.

* * * * *